United States Patent [19]

Arntyr et al.

[11] Patent Number: 4,475,844

[45] Date of Patent: Oct. 9, 1984

[54] METHOD AND APPARATUS FOR RESTRICTING LOCAL VARIATIONS IN GROUND LEVEL IN THE VICINITY OF SURFACE WATER DRAINS AND MANHOLES

[76] Inventors: Oscar S. Arntyr, Wallingatan 37, S-111 24 Stockholm; Thord I. Engström, S-950 18 Bensbyn, both of Sweden

[21] Appl. No.: 463,448

[22] PCT Filed: May 27, 1982

[86] PCT No.: PCT/SE82/00189

§ 371 Date: Jan. 26, 1983

§ 102(e) Date: Jan. 26, 1983

[87] PCT Pub. No.: WO82/04276

PCT Pub. Date: Dec. 9, 1982

[30] Foreign Application Priority Data

May 29, 1981 [SE] Sweden ..... 8103405

[51] Int. Cl.[3] ..... E01F 5/00; E02D 29/12

[52] U.S. Cl. ..... 404/2; 404/25; 405/36; 405/130; 52/19; 52/170; 210/166

[58] Field of Search ..... 404/2, 3, 4, 5, 25, 404/26; 52/19, 20, 21, 166, 170; 210/163, 164, 165, 166; 405/130, 36; 137/364, 371; 138/106, 107

[56] References Cited

U.S. PATENT DOCUMENTS

| | | | |
|---|---|---|---|
| 254,662 | 3/1882 | Kinney | 52/170 X |
| 416,830 | 12/1889 | Park | 404/4 X |
| 856,702 | 6/1907 | Howley | 404/2 |
| 1,830,065 | 11/1931 | Luff | 210/165 |
| 2,846,852 | 8/1958 | Cappel | 52/170 X |
| 3,299,785 | 1/1967 | James | 404/4 |
| 4,388,015 | 6/1983 | Honegger | 404/2 |

FOREIGN PATENT DOCUMENTS

| | | | |
|---|---|---|---|
| 1151226 | 7/1963 | Fed. Rep. of Germany | 405/36 |
| 1266243 | 4/1968 | Fed. Rep. of Germany | 404/5 |
| 2948050 | 6/1981 | Fed. Rep. of Germany | 210/163 |

*Primary Examiner*—Stephen J. Novosad
*Assistant Examiner*—Beverly E. Hjorth
*Attorney, Agent, or Firm*—Sughrue, Mion, Zinn, Macpeak, and Seas

[57] ABSTRACT

A tubular drain vertically positioned within the ground beneath the ground level in the vicinity of surface water and having a tubular drain cover-support member anchored in the surface ground layer with a tubular part of the drain cover-support means extending down into the tubular drain, so as to be axially movable relative thereto as a separately movable support element in annular disc form placed around the tubular part of the drain cover-support member so as to be axially movable relative to the drain while being guided by the upper part with it being anchored in the surrounding ground layer in a manner so as to be able to exert a downwardly pressing force from the underlying drain when relative movement is obtained between the drain and the supporting element.

8 Claims, 2 Drawing Figures

METHOD AND APPARATUS FOR RESTRICTING LOCAL VARIATIONS IN GROUND LEVEL IN THE VICINITY OF SURFACE WATER DRAINS AND MANHOLES

TECHNICAL FIELD

The present invention relates to a method for restricting local variations in ground level in the vicinity of surface-water drains and manholes, at locations where the freezing and unfreezing of the ground causes the ground and parts of drainage systems located therein to move. The invention also relates to apparatus for use when carrying out the method.

BACKGROUND OF THE INVENTION

When subjected to rapid variations in temperature, the level between the cover-support means of a surface-water drain or manhole and the surrounding ground surface will often vary quite considerably. Since this type of drain is normally located in drive ways, such as roads, such variations in level present a driving hazard and are expensive to rectify.

Such variations in level are mainly caused by the ground freezing during the Autumn and Winter months, the ground, which contains water, expanding when frozen, with subsequent lifting of the ground level, and by partial unfreezing of the ground in the vicinity of the drain or manhole during the Spring months, with reduced firmness of the ground as a result. By way of example, it can be mentioned that when ground which contains a lot of water is subjected to extreme cold over a long period of time, the ground level can rise from 30–40 cm.

Aforementioned local variations in level can occur, among other things, as a result of the ground freezing at different depths at different moments in time, and also because the extent to which the ground unfreezes varies with depth and with distance from a drain or manhole. The following events can take place in the case of a conventional drain or manhole, hereinafter referred to generally as water drain. When the ground freezes, the level of the ground rises, causing the drain cover-support means to be lifted, so that the ground surface remains substantially flat. In warmer weather, the ground in the immediate vicinity of the drain will often unfreeze more rapidly than the surrounding ground, consequently reducing the firmness or supporting power of the ground adjacent the water drain, which may either result in the whole of the drain sinking relative to the surrounding ground, to form a pit, or as is more usual, causing the ground layer immediately surrounding the drain cover to disintegrate and sink to form a crater around the drain cover. The reason why the ground around a water drain will unfreeze more rapidly than ground more distance therefrom is sometimes because of the water from melted snow or ice entering the outside or inside of the drain, thereby heating the same. Air currents in the drain are also liable to heat the same. This is particularly noticeably when steam is used to unfreeze a frozen drain. Sometimes a drain will remain in a lifted position when the level of the surrounding ground has fallen, as a result, among other things, of ground which remains frozen at a deeper level, the raised drain constituting an obstacle and a hazard to traffic.

OBJECT OF THE INVENTION

The main object of the present invention is to provide a method and an arrangement for eliminating or reducing the aforementioned problems.

BRIEF SUMMARY OF THE INVENTION

This object is achieved in accordance with the invention by using a supporting element which surrounds the drain cover-support means at a location immediately beneath the surface layer. The drain cover-support means shall be axially moveable relative to the supporting element, and the element, in turn, shall be axially moveable relative to the upper part of the drain. Hence, such a supporting element will carry out several different functions. Among other things, it will prevent the surface layer from disintegrating and forming craters around the drain cover should the ground unfreeze locally during warmer weather, e.g. in the Spring, since it improves the supporting power of underlying material. The supporting element will also lead away water deriving from frozen ice and snow, thereby preventing local unfreezing of the ground layer surrounding the well. Since the supporting element will accompany movement of the ground layer immediately beneath the surface layer, said element will also exert a downwardly pressing force on the drain when the surface layer sinks. This is of particular importance in the case of light drains located in regions of ligth traffic, since otherwise such drains may remain in a lifted position. A corresponding effect will also prevent light drains, for example drains made of plastic pipes, from being pressed upwardly be earth pressure.

The use of a supporting-element structure has previously been suggested, c.f. SE 7712565-6 and NO 141 319. These supporting elements, however, have only been intended for supporting the drain cover-support means, among other things to prevent forces being transmitted to the drain itself. Such a supporting element cannot fulfil the function of the supporting element according to the present invention.

In accordance with the present invention a method of the kind mentioned in the introduction is particularly characterized by anchoring the drain cover-support means in the surface layer in a conventional manner, and so that a tubular part of the cover-support means projects down into the drain axially moveable relative thereto; and by placing a supporting element around said tubular part of the drain cover-support means, so that said supporting element is axially displaceable relative to the drain cover-support means while guided by the upper part of the drain; and by anchoring the supporting element in the surrounding ground.

Preferably, the supporting element is arranged so as to be telescopically displaceable relative to the upper part of the drain, substantially in tight peripheral abutment with the tubular part of the drain.

In a preferred embodiment of the invention, the supporting element comprises a circular disc, whose outer diameter is of the order of twice the drain diameter. It is important that the supporting element extends over a relatively long distance outside the drain, so as to increase the carrying power and to obtain a reliable anchorage in the ground. Suitably, the supporting element is designed so that it can be fixed to a holder displaceably arranged on the upper edge of the drain, without using loose attachment means.

In order to reduce still further the risk of the drain being heated by water deriving from snow or ice, the tubular part of the drain cover projecting down into the drain is suitably provided with a throat.

The invention will now be described in detail with reference to the accompanying drawing.

DESCRIPTION OF A PREFERRED EMBODIMENT OF THE INVENTION

Figure 1:
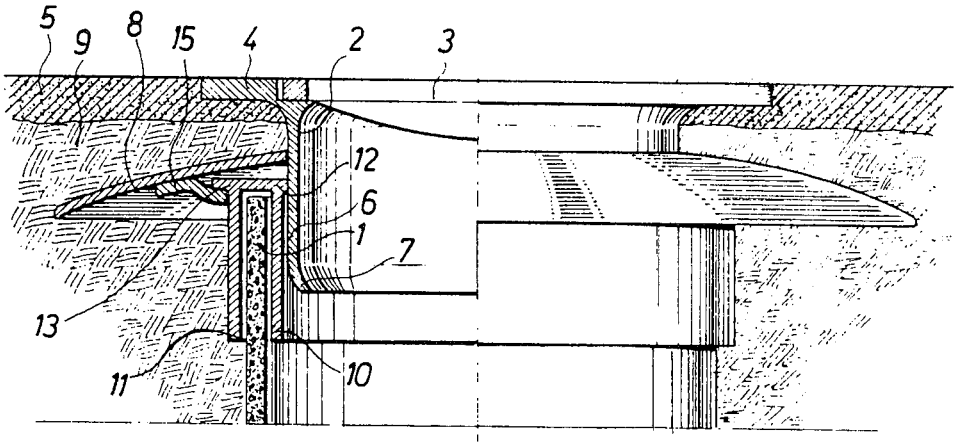
FIG. 1 is a side view, partly in section taken on the line I—I in FIG. 2, of an arrangement according to the invention mounted on a surface-water drain.

The reference 1 identifies the upper part of a water drain, while reference 2 identifies a drain cover-support means supporting a grating 3. The drain cover-support means 2 is provided with a peripheral flange 4, by means of which said support menas can be firmly anchored in the surface layer 5, for example an asphalt coating, so as to produce a perfectly smooth ground surface. As will be seeen, the drain cover-support means 2 is provided with a lower, tubular part 6, which projects down into the drain 1. The lower part of the tubular portion 6 is provided with a throat 7, which among other things prevents warm, melted ice or snow from running along the wall of the drain 1 and warming the same. The throat also greatly reduces the amount of dirt deposited on the wall of the drain, said dirt otherwise forming a good germinating substrate for fungi, moss and the like.

The tubular portion 6 of the drain cover-support means is encircled by a supporting or bearing element 8, which extends outwardly into the surrounding ground layer 9 over a relatively long distance, thereby to provide a good anchorage for the supporting element and a high bearing power, even though the material in the layer 9 is relatively loose. The supporting element 8 peripherally abuts the tubular portion 6 quite tightly, but shall be able to move up and down relative to said tubular portion, whereat said element also effectively conducts away any water penetrating down the outside of the drain cover 2. Thus, this water will not contribute towards heating the actual drain 1.

In the illustrated embodiment the supporting element 8 has the form of an annular plate which, in order to have sufficient rigidity, is arched. As will be understood, sufficient rigidity can be imparted to a flat plate by corrugating the same. A flat, corrugated plate may be preferred from the aspect of manufacture. Preferably, the outer diameter of the plate is about twice the diameter of the dain.

Figure 2:
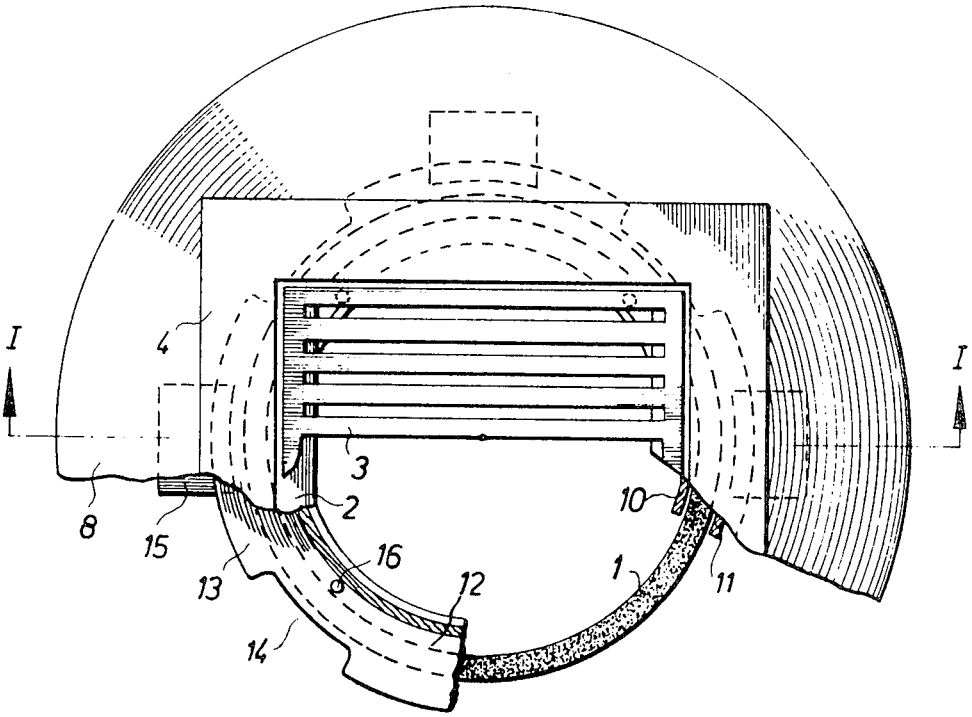
FIG. 2 is a horizontal, part-sectional view of the arrangement according to FIG. 1.

In the illustrated embodiment, the supporting element 8 is fixed to a holder arranged on the upper part 1 of the drain, without the use of loose attachment means. In the illustrated case, the holder comprises a sleeve having double walls 10 and 11 joined together by means of a ring-shaped part 12 and slided over the upper end part 1 of the drain. The connecting part 12 is provided with an outer flange 13 which, as will be seen from FIG. 2, is provided with recesses 14. The supporting element 8 is provided underneath with mounting tongues 15, which fit into the recesses 14 and which when rotating the supporting element 8 lock said element to the flange 13. In this way, the supporting element 8 retains its ability to move vertically relative to both the tubular part 6 of the drain cover-support means 2 and the upper part 1 of the drain, since the double-wall sleeve 10, 11, 12 can be displaced telescopically relative to the drain whilst being guided by the upper part 1 of said drain.

Thus, in the illustrated arrangement the drain cover-support means 2 will accompany the movement of the grond as it is lifted when the earth in the outer layer 5 freezes during the cold Autumn months, resulting in a flat ground surface. As beforementioned, when the ice and snow melts in warmer weather, the water is prevented from running down along the inner and outer surfaces of the drain 1, as a result of the throat 7 and the supporting element 8. If the ground layer around the drain 1 should, nevertheless, partially unfreeze, the supporting element 8 will obtain sufficient support from the material 9 located beneath the surface layer, thereby preventing the surface layer 5 from disintegrating with the resultant formation of craters and pits around the outer flange 4 of the dain cover 2. The supporting element 8 also prevents any tendency of the drain cover 2 when loaded to sink beneath the level of the outer layer 5, when the ground layer 9 therebeneath unfreezes, and also serves to relieve the drain of any load exerted thereon, which is significant when the drain is made of plastic pipes.

Because the supporting element 8 has a relatively large area, the element is also able to exert a downwardly pressing force on the drain 1 as a result of the weight of the ground material located on top of said element, among other times in conjunction with the unfreezing and sinking of the level of the surface layer 5 and the ground layer 9 located immediately therebeneath. Thus, the supporting element 8 will accompany the movement of the ground layer.

To permit a certain amount of movement of the drain 1, the supporting element 8 is suitably positioned so that initially there is a clearance between the upper end of the drain 1 and the connecting part 12. Optionally, a fixing mass can be pressed down through holes 16 in the connecting part 12, to hold the supporting element at a given level relative to the drain 1.

When the drain is made of a light material, usually a plastics material, the supporting element 8 can also serve to prevent the drain from being urged upwardly by surrounding ground pressure. Light drains not provided with a supporting element are liable to be lifted by pressures acting in the surrounding ground. In this case, the counter-acting force which the supporting element 8 is able to exert on the drain plays an important role.

As will be understood from the aforegoing, all parts are axially moveable relative to one another, although so guided as to prevent radial displacement between said parts.

The described embodiment is not limitive of the invention, but can be modified in several respects. For example, the holder for mounting the supporting element on the drain can be varied as desired. In the illustrated holder, the outer and inner pipe walls can, for example, have mutually different heights and one wall optionally excluded altogether. Neither need the guide means of the holder have the form of closed tubular walls. Although it is preferred to secure the supporting element to the holder without the use of loose attachment means, as with the illustrated embodiment, other attachment methods can be used, for example bolts or like fasteners. The design of the supporting element can be modified as desired. For example, the supporting element can be made in one piece and provided with means which guide or abut the drain. Preferably, instead of being completely rigid, the supporting element is able to yield a little. As will be understood, the use of a supporting element arrangement according to the invention can also be used with other types of dains and drain cover-support means, irrespective of their geometric shape. Those problems solved by means of the invention, however, are particularly found with surface water drains, and can also exist with manholes.

I claim:

1. A method of restricting local variations in ground level in the vicinity of surface water drains and manholes at locations where the freezing and unfreezing of the ground causes the ground and parts of the drainage system located therein to move, wherein a tubular drain is inserted vertically in the ground and a drain cover-support means is anchored in the surface ground layer so that a tubular part of the drain cover-support means extends down into the tubular drain so as to be axially movable relative thereto; said method comprising:

placing a separately movable supporting element around the tubular part of the drain cover-support means so as to be axially movable relative to the drain while being guided by the upper part thereof, and anchoring the supporting element in the surrounding ground layer so as to be able to exert a downwardly pressing force on the underlying drain when a relative movement is obtained between the drain and the supporting element.

2. The method according to claim 1, including the step of arranging the supporting element substantially tightly around the tubular part of the drain cover-support means.

3. A structural arrangement in surface water drains and manholes for restricting local variations in ground level in the vicinity of surface water drains and manholes comprising a vertically oriented tubular drain, at locations where the freezing and unfreezing of the ground causes the ground and parts of the drainage system located therein to move, said arrangement including a drain cover-support means (2) arranged to be anchored in the surface ground layer (5) and provided with a tubular part (6) which projects down into the drain (1) and is axially movable relative to said drain; and a supporting element (8) which is arranged around the tubular part (6) of said drain cover-support means (2) and being separate therefrom and axially displaceable relative to the drain (1) while being guided by the upper part thereof, and said supporting element being arranged to be anchored in the surrounding ground layer and being provided with means (10, 11, 12) by which the supporting element (8) can exert a downwardly pressing force on the underlying drain (1) when a relative movement is obtained between the drain and the supporting element (8).

4. The structural arrangement according to claim 3, wherein the supporting element is a circular disc (8), in a substantially tight peripheral abutment with the tubular part (6).

5. The arrangement according to claim 4, wherein the outer diameter of the circular disc (8) is about twice that of the diameter of said drain (1).

6. The arrangement according to claim 5, wherein said means comprises a holder means (10, 11, 12) displaceably mounted on the upper part of said drain (1), said supporting element (8) being connected to said holder means.

7. The arrangement according to claim 6, wherein the holder means (10, 11, 12) is mounted for sliding movement on the upper part of said drain (1).

8. The arrangement according to claim 3, wherein the lower part of the tubular part (6) of the drain cover support-means (2) is provided with a radially inwardly directed throat (7) for directing the water away from the inside of the tubular drain (1).

* * * * *